United States Patent [19]

Hall

[11] 4,103,739

[45] Aug. 1, 1978

[54] SAND RELEASE APPARATUS FOR A PUMP

[76] Inventor: L. D. Hall, P.O. Box 264, Hull, Tex. 77564

[21] Appl. No.: 720,246

[22] Filed: Sep. 3, 1976

[51] Int. Cl.[2] ..... E21B 43/00

[52] U.S. Cl. ..... 166/105; 166/334; 417/434

[58] Field of Search ..... 166/105, 334, 317; 417/434

[56] References Cited

U.S. PATENT DOCUMENTS

| | | | |
|---|---|---|---|
| 1,601,676 | 9/1926 | Burright | 166/334 |
| 2,501,237 | 3/1950 | Sanders | 417/434 |
| 2,526,086 | 10/1950 | Sanders | 417/434 |
| 2,854,929 | 10/1958 | McGowen, Jr. et al. | 417/434 |
| 3,233,677 | 2/1966 | Myers | 166/334 |
| 3,414,057 | 12/1968 | Harbison | 417/434 |

*Primary Examiner*—James A. Leppink

*Attorney, Agent, or Firm*—Donald Gunn

[57] ABSTRACT

In oil wells which utilize a reciprocating pump installed in a tubing string, an apparatus is disclosed which has the preferred form of a pair of telescoped tubular members threaded into the pump just above the lower end where sanding locks the pump. The two are telescoped together and are pinned by a shear pin. When it is time to pull the pump, if there is undue resistance to its removal from the tubing string, the shear pin will shear, releasing the two for telescoping movement. The innermost sleeve has a protruding shoulder limiting its upward travel. When the telescoping movement occurs, a set of slots is exposed. The slots open to the interior, and sand accumulated around the tool under pressure of a column of liquid standing thereabove washes down through the slots and out of the way. If no sanding occurs, the shear pin is not sheared and the two telescoped members maintain their original position.

8 Claims, 3 Drawing Figures

SAND RELEASE APPARATUS FOR A PUMP

BACKGROUND OF THE INVENTION

Many wells produce substantial volumes of oil mixed with some water and sand. Sand flows from the formation with the fluids into the well. A typical pumping well normally includes a tubing string which is perforated at the lower end to admit fluid from the producing formation into the tubing string. The fluid flow from the formation carries with it some of the sand. As the fluid level in the well rises to submerge the pump, the pump is able to operate. Moreover, the stirring and agitatation of the pump tends to keep sand suspended in the liquid. Thus, the pump will lift a substantial quantity of sand.

Some wells are able to be pumped continuously. Others must be shut down periodically. In both cases, the pump lifts a column of liquid which stands from the pump to the well head. As the column is lifted, the sand in it tends to settle out. Depending on the viscosity of the recovered fluids, the size of the sand particles and their quantity, they tend to settle back and fall to the bottom of the tubing string. When this occurs, the pump itself will be sanded up on the exterior.

A pump is normally installed by fitting it against an inwardly protruding shoulder, and a seal is perfected below the shoulder by incorporating a set of encircling seal rings on the pump. If a significant quantity of sand settles on the pump, it makes it impossible to pull the pump. The pump then is locked in its position by the sand particles which settle around it.

The present invention is an apparatus which relieves this problem. It is an apparatus to be incorporated with pre-existing pumps or newly manufactured pumps. It is a modification to pre-existing pumps in that it is able to be installed at least in certain models of pre-existent pump to relieve sand locking in the well.

It has been discovered that the sand collects at a location typically just above the inwardly protruding shoulder where the pump is supported at the desired elevation. The present invention is a pair of telescoping tubular members which are installed in that pump. The exterior wall of the pump in ordinary circumstances is thus unmodified, namely, it remains an elongate tubular structure. The present invention thus incorporates a pair of telescoped tubular members which are joined together by a shear pin. As long as the axial load on the pump during retrieval is less than the anticipated load, indicating that the pump is not sand locked, then the tool is readily retrieved and the present invention is not required to operate to relieve the sand lock of the pump. It is only when pump is sand locked that the present invention comes into play. It incorporates a pair of tubular sleeves which are telescoped together. The outermost tubular sleeve is threaded to the lower end of the pump. The interior tubular sleeve is threadedly joined to the upper portions of the pump. The two are shear pin joined in the retracted condition. It is only when resistence is encountered that the present invention comes into play. If the pump is sanded and therefore locked in the tubing string, a suitable upward pull breaks the shear pin which joins the telescoped tubular members. The internal tubular member has a surrounding protruding lip at the lower end which is sufficiently large to lock it against pulling through the outer tubular member. When the shear pin is broken, the inner tubular member slides upwardly and positions a set of slots which open to the interior adjacent to the sand. The sand is then washed through the slots and down through the center of the tool and out through the bottom of the pump which is hollow. The invention works quite well even if the sand extends many feet above the pump. It should be kept in mind that the column of liquid standing above the pump is able to wash down past the pump and into the slots carrying great quantities of sand with it.

SUMMARY OF THE DISCLOSURE

The present apparatus is an adaptive device for pre-existed oil pumps or is to be incorporated in newly constructed pumps. The device incorporates a pair of telescoping tubular sleeves, the outer sleeve threading to the lower portion of the tool and the inner sleeve threading to the upper portion of the tool. When placed in a pump it provides a feature whereby sand locking is relieved. The two tubular members are pinned together with a shear pin. They are pinned in the closed position. When the shear pin is broken, the telescoping members separate to their maximum length. When this occurs, the inner member then exposes a set of lengthwise slots for drainage through the tool. Sand adjacent to the pump is then washed through the slots into the pump and flows out through the bottom. This enables the locked-in oil pump to be relieved of sand locking.

DESCRIPTION OF THE PREFERRED EMBODIMENT

Figure 1:
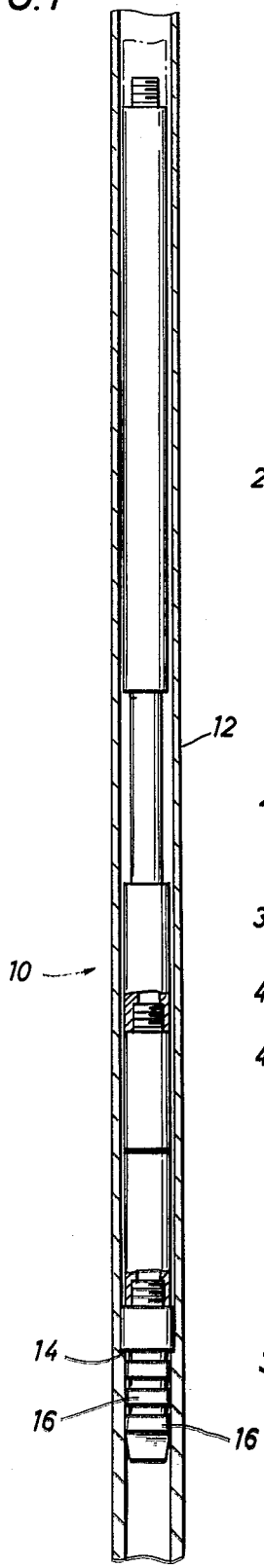
FIG. 1 is a sectional view through a tubing string showing a pump modified with the present invention and installed in the string to enable the pump to be relieved of sand locking at the time of servicing.
Figure 2:
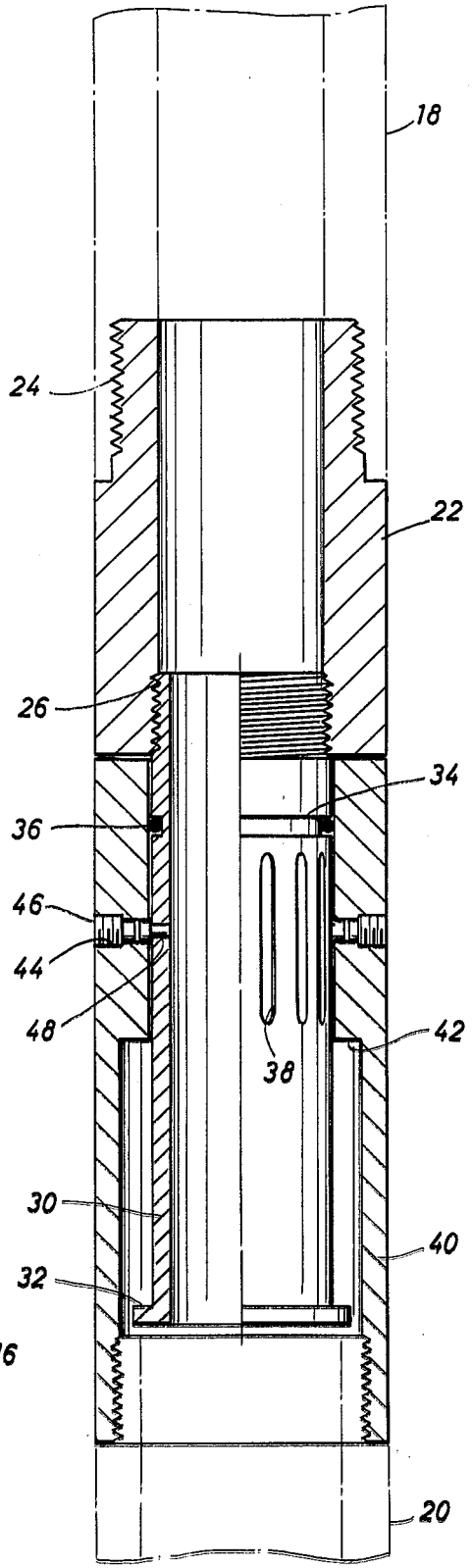
FIG. 2 is a sectional view through the pump modified in accordance with the teachings of the present invention and showing a pair of telescoped tubular members which are joined together by a shear pin.

In FIG. 1 of the drawings, a pump is generally indicated by the numeral 10. It is located in a tubing string 12. The tubing string 12 includes a shoulder 14. The pump itself rests on the shoulder 14. A set of resilient rings 16 located below the shoulder seal the pump against leakage. The pump is axially open at the bottom and is able to lift oil and typically substantial volumes of water in response to reciprocation. The pump itself is joined to a walking beam mechanism at the surface by means of sucker rods which extend all the way to the surface. They are reciprocated slowly to operate the lift pump mechanism. The present invention is thus intended to be equipment added to a pre-existing pump. In the alternative, it can be incorporated in a newly manufactured pump. It is shown in the form of tubular members to be threaded to a pump; in new pump manufacture, the threads can be omitted and the tubular sleeves to be described are formed integrally with other components of the body of the pump. In any case, reference is made to FIG. 2 of the drawings where the upper portions of the pump 10 are indicated by the numeral 18, and the lower portion of the pump has been identified by the numeral 20. These are pre-existing components; as stated, they can be joined or formed integrally by omission of the threads. The upper part 18 is threadedly joined to a tubular coupling 22. It serves as a coupling or adapter joining to the upper part of the pump. It is in turn provided with threads 24 at the upper end. It is internally threaded at 26 at the lower end to enable it to join to a first tubular sleeve 30. The tubular sleeve 30 is the smaller of the two sleeves comprising the present invention. The tubular sleeve 30 has a protruding external lip or shoulder 32 at the lower end. The shoulder 32 serves as a lock as will be described. The tubular sleeve 30 is smooth on the exterior except at one location where it is cut with a groove 34 and an O-ring 36 is located in the groove. This serves as a seal. The seal prevents unintended leakage along the exterior of the sleeve 30.

At a selected position along the length of the sleeve 30, a set of slots 38 is formed. Several slots are formed around the sleeve. The many slots are fairly long. They have a width which is more than adequate to enable sand laden oil to flow through the slots. The several slots are fairly long and preferably all have an equal length. This of course is not mandatory. The several slots in the aggregate provide a relief path to the interior of the sleeve 30 which enables the pump 10 to be freed of a sand lock. An alternate form is a set of circular openings, or openings of any selected shape and number.

The numeral 40 identifies the outer tubular member. The tubular member 40 is positioned on the exterior of the first tubular member 30. The tubular sleeve 40 is threaded at the lower end to enable it to connect to the lower portions of the pump indicated at the numeral 20 in FIG. 2. The outer tubular member 40 is larger than the tubular member 30 and fits about it. As shown in the drawings, it incorporates an internally directed shoulder 42. The shoulder 42 serves as a lock against the protruding lip 32 on the sleeve 30. This limits upward travel on telescoping movement. When telescoping movement occurs, the shoulder 42 blocks the lip 32 against further movement.

The shoulder 42 is fairly long and sits adjacent to the tubular member 30 to enable it to be aligned, thereby preventing canted movement. In addition, it serves as a surface working against the seal 36 thereby limiting leakage through the tool in the unactuated condition.

The numeral 44 identifies a tapped opening formed in the sidewall of the tubular sleeve 40. It is a large hole which is internally tapped for receiving a threaded plug. The plug itself is identified by the numeral 46. The plug has a protruding shear pin affixed to it which extends from the tapped opening 44 into a matching opening 48. The opening 48 is formed in the inner sleeve 30. The shear pin thus joins the two tubular members together. When they are joined together, the slots 38 are not exposed. The dimensions of the inner sleeve 30, and particularly the length thereof to the lip 32, are such that the slots 38 are moved to the upper end of the tubular sleeve 40. The slots 38 are then positioned in an exposed location. It is desirable that the slots terminate just below the shoulder 50 at the upper end of the tubular sleeve 40. The shoulder 50 thus defines the gap or opening which is formed in the tool when it is sand locked. The slots 38 open to the interior. The lower portion 20 of the pump is axially hollow. This permits the column of liquid standing above the pump to wash down past the pump. It permits the liquid to divert to the interior of the pump, thereby avoiding the seal rings 16. As the column of liquid flushes through the slots 38, it washes away the sand which locks the pump in the tubing string 12. As a consequence, the sand is carried away from the pump. exposed. It may take a few minutes for the column of liquid standing above the pump to wash down through the pump. As it flows through the pump at the slots 38, it washes sand away from the pump. As the sand is washed away, the pump is freed of the sand lock, and it can thereafter be retrieved quite easily. If desired, a pump at the well head can be used to force the liquid back through the pump. Portable pumps are available for this purpose.

Figure 3:
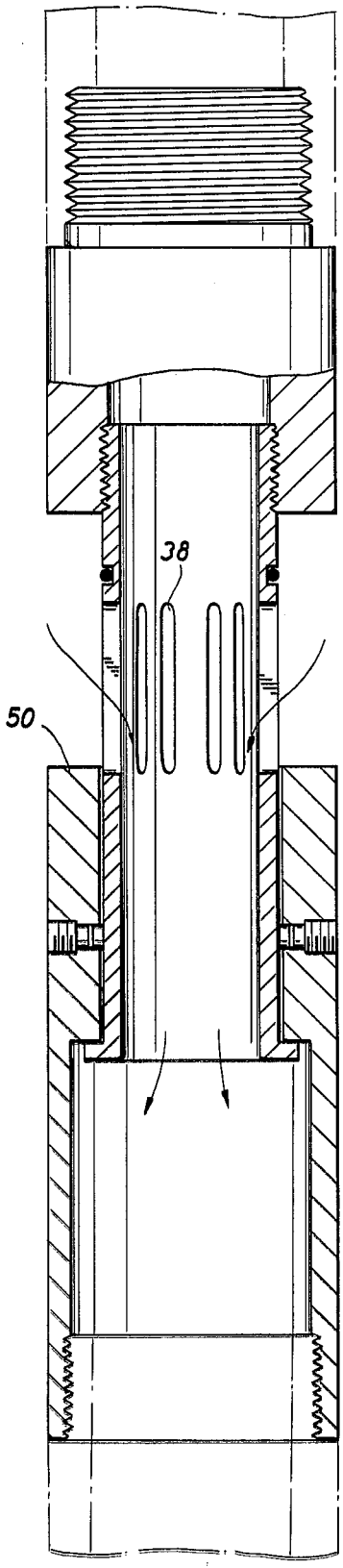
FIG. 3 is a view similar to FIG. 2 showing the tubular members after telescoping apart to thereby position a set of slots where the sand in the well is able to wash downwardly and away from the pump to relieve the sand lock.

The device operates in the following manner. It will be presumed to be installed in a pump and it is immaterial whether the pump is of new manufacture or the device is installed as a retrofit. In any case, the pump is installed in the tubing string 12 and produces for a period of time. When it is time to service the pump, the pump is pulled upwardly using the sucker rods. If it pulls upwardly and encounters no undue resistence as a result of sanding, the entire pump is retrieved and the present invention does not operate, remaining with the pump, and is ready to operate on the next service call. If however, the pump encounters substantial resistance on retrieval from the tubing string 12, this is an indication that the pump is sand locked. If the resistance is sizable the axial pull on the pump fractures the shear pin and frees the sleeves for telescoping movement. The pump body itself slides upwardly, locking of the pump customarily occurring near the bottom so that the lower portion 20 of the pump is held by the sand lock. When the telescoping movement occurs, the slots 38 are pulled to an exposed position as illustrated in FIG. 3. As they are being exposed, their upward travel and hence ultimate location is limited by the lip 32 which is locked against the shoulder 42. This movement limits the slots to the desired location.

An upward pull is thus taken on the sucker rod string which is sufficient to shear the pin joining the two sleeves. At the next juncture, the upward strain is continued on the pump to hold the upper portions of the pump in a raised position. As long as the pump remains sand locked, the strain is continued. This keeps the slots 38 As was observed, the apparatus can be incorporated in a newly manufactured pump by integral construction.

The foregoing is directed to the preferred embodiment which is shown as separable components. It is also possible to integrally construct the components. Many modifications and alterations can be incorporated in the apparatus but the scope thereof is determined by the claims which follow.

I claim:

1. An improvement in an oil well pump which pump is typically installed in a well for lifting liquid to the surface which liquid carries with it sand and which pump is exposed to sand locking between the pump and the tubing string in which it is installed, the improvement comprising first and second tubular sleeves which are telescoped together to be incorporated in the body of the pump and forming an elongate tubular extension thereof, said tubular sleeves being joined by a means which is operable only on exceeding an axial pull beyond a specified level which relatively axially separates the sleeves, one of the sleeves being affixed to the upper portions of the pump and the other of the sleeves being affixed to the lower portions of the pump and which sleeves are in a closed telescoping arrangement prior to pulling and which pull apart to an extended telescoping arangement, and a set of drain opening means on the inner sleeve which opening means are exposed upon extending telescoping movement to thereby drain sand around the exterior of the pump through the opening means to the interior of the pump and downwardly through the lower portions thereof and wherein said lower sleeve closes said drain opening means by encircling said upper sleeve and including a seal means above said drain opening means for sealing against flow through said drain opening means prior to extension by telescoping movement.

2. The apparatus of claim 1 including an outwardly protruding shoulder on the inner sleeve and an inwardly protruding shoulder on the outer sleeve which shoulders lock together to limit telescoping axial movement of the two tubular sleeves.

3. The apparatus of claim 1 including a shear pin received in appropriately aligned openings formed in the inner and outer sleeves.

4. The apparatus of claim 1 including an encircling seal sealing the space between the inner and outer tubular sleeves.

5. The apparatus of claim 1 including an outer sleeve sized to approximately equal the diameter of the pump.

6. The apparatus of claim 1 including a hollow coupling having threads at both ends thereof, said coupling adapted to join a pre-existing pump body to the upper end of one of the telescoping sleeves.

7. The apparatus of claim 1 wherein said telescoping tubular members are sealed by a seal means between them, and including a shear pin located in shear pin holes formed in said tubular sleeves.

8. The apparatus of claim 7 wherein the shear pin includes a tapped hole and a plug.

* * * * *